US008800114B2

(12) United States Patent
Brown

(10) Patent No.: US 8,800,114 B2
(45) Date of Patent: Aug. 12, 2014

(54) MODULE FEEDER SYSTEM AND METHOD TO USE SAME

(76) Inventor: Joe Goodwin Brown, Tunica, MS (US)

( * ) Notice: Subject to any disclaimer, the term of this patent is extended or adjusted under 35 U.S.C. 154(b) by 0 days.

(21) Appl. No.: 13/330,317

(22) Filed: Dec. 19, 2011

(65) Prior Publication Data

US 2013/0152345 A1 Jun. 20, 2013

(51) Int. Cl.
*B65B 69/00* (2006.01)

(52) U.S. Cl.
USPC ..... 19/64.5

(58) Field of Classification Search
USPC ..... 19/64.5; 414/412
See application file for complete search history.

(56) References Cited

U.S. PATENT DOCUMENTS

| | | | | |
|---|---|---|---|---|
| 3,757,973 | A | 9/1973 | Lambert et al. | |
| 4,610,596 | A | 9/1986 | Bouldin et al. | |
| 4,929,141 | A | 5/1990 | Keesey et al. | |
| 5,318,399 | A | 6/1994 | Marom | |
| 5,454,683 | A | 10/1995 | Marom et al. | |
| 5,771,661 | A | 6/1998 | Martin | |
| 6,200,084 | B1 * | 3/2001 | Self et al. | 414/607 |
| 6,863,486 | B2 | 3/2005 | Ours et al. | |
| 7,165,928 | B2 | 1/2007 | Haverdink et al. | |
| 7,757,353 | B2 | 7/2010 | Stover | |
| 2005/0207877 | A1 | 9/2005 | Haverdink et al. | |
| 2006/0191241 | A1 | 8/2006 | Deutsch et al. | |
| 2009/0202327 | A1 | 8/2009 | Cory et al. | |
| 2009/0238667 | A1 | 9/2009 | Curles | |
| 2010/0270383 | A1 | 10/2010 | Stover | |
| 2011/0194918 | A1 | 8/2011 | Freeman | |

* cited by examiner

*Primary Examiner* — Shaun R Hurley
(74) *Attorney, Agent, or Firm* — Baker, Donelson, Bearman, Caldwell & Berkouity, PC

(57) ABSTRACT

A module feeder system is disclosed. The module feeder system comprises a module feeder which has an unload bed, a feeder bed, a first side wall and a second side wall. A cutting device is attached to the feeder bed. At least one hydraulic cylinder is positioned on each of the first and second side walls. Each hydraulic cylinder is configured to project in a direction away from the sidewalls and over the feeder bed. A method used to unwrap a cotton module is also disclosed.

9 Claims, 5 Drawing Sheets

MODULE FEEDER SYSTEM AND METHOD TO USE SAME

FIELD

The present disclosure relates generally to a module feeder system and method to use the same. More specifically, the present disclosure relates to a module feeder system and method to unwrap round cotton modules as the seed cotton is conveyed and fed into the cotton gin.

BACKGROUND

In modern cotton production, seed cotton commonly arrives at a cotton gin in compressed modules which are wrapped in plastic. Cotton modules are built on the cotton field by a cotton module builder, a machine used in the harvest and processing of cotton. The module builder allows cotton to be harvested quickly and compressed into large modules which are subsequently tarped and temporarily stored at the edge of a cotton field until they are loaded on trucks and carried to a cotton gin for processing. When the cotton modules arrive at the cotton gin, they are placed on cotton module feeders which are designed to move cotton from delivery to the cotton gin. Cotton module feeders break up or disperse the cotton modules and feed the cotton into the gin. The cotton gin quickly and easily separates cotton fibers from their seeds. The resulting cotton fibers are then processed into cotton goods.

At some point before the seed cotton enters and is processed in the cotton gin, the cotton module must be unwrapped or untarped. All wrap/tarp is removed from the cotton module to eliminate wrap contamination in the resulting cotton fibers. In addition, when the wrap is removed, all cotton is left inside the feeder to maximize the amount of processed cotton. Various systems and methods are used to unwrap cotton modules. Such various systems and methods may unwrap the cotton module either before or after the cotton module is placed on the module feeder. Such existing systems and methods often include heavy machinery that must be attached to the module feeder. Such systems may include hydraulic powered systems that lift and rotate the cotton module to unwrap it. Such additional machinery is expensive and massive requiring a substantial amount of space in addition to the cotton module feeder system.

A module feeder system and method used to unwrap cotton modules that is both effective and efficient is needed.

BRIEF SUMMARY

A module feeder system is disclosed. In one example embodiment, the module feeder system comprises an unload bed, a feeder bed, a first side wall and a second side wall. The module feeder system comprises a cutting device attached to a feeder bed and at least one hydraulic cylinder positioned on each of the first and second side walls. In one embodiment, each hydraulic cylinder may be configured to project in a direction away from the sidewalls and over the feeder bed.

In one example embodiment, the module feeder system comprises a cutting device which may be configured to project from the feeder bed. In another example embodiment, the module feeder system comprises a cutting device which may be stationary. In yet another example embodiment, the module feeder system comprises two hydraulic cylinders which are positioned on each of the first and second side walls. In a further example embodiment, the module feeder system comprises a belt feed.

A method used to unwrap a cotton module is also disclosed. The method may comprise the following steps: (a.) placing a wrapped cotton module on a module feeder, wherein the module feeder has an unload bed, a feeder bed, a first side wall and a second side wall, wherein a cutting device is attached to the feeder bed, wherein at least one hydraulic cylinder is positioned on each of the first and second side walls, wherein each hydraulic cylinder is configured to project in a direction away from the sidewalls and over the feeder bed; (b.) activating the module feeder unload bed and feeder bed; (c.) cutting the wrap on the cotton module with the cutting device as the cotton module moves onto the feeder bed; and (d.) removing the wrap from the cotton module by activating the hydraulic cylinders which move the module from side to side.

In one example embodiment, the method comprises a cutting device which may be configured to project from the feeder bed. In another example embodiment, the method comprises a cutting device which may be stationary. In yet another example embodiment, the method comprises two hydraulic cylinders which are positioned on each of the first and second side walls.

BRIEF DESCRIPTION OF THE DRAWINGS

The present disclosure will be better understood by reference to the following detailed description when considered in conjunction with the accompanying drawings wherein.

DETAILED DESCRIPTION

Figure 1:
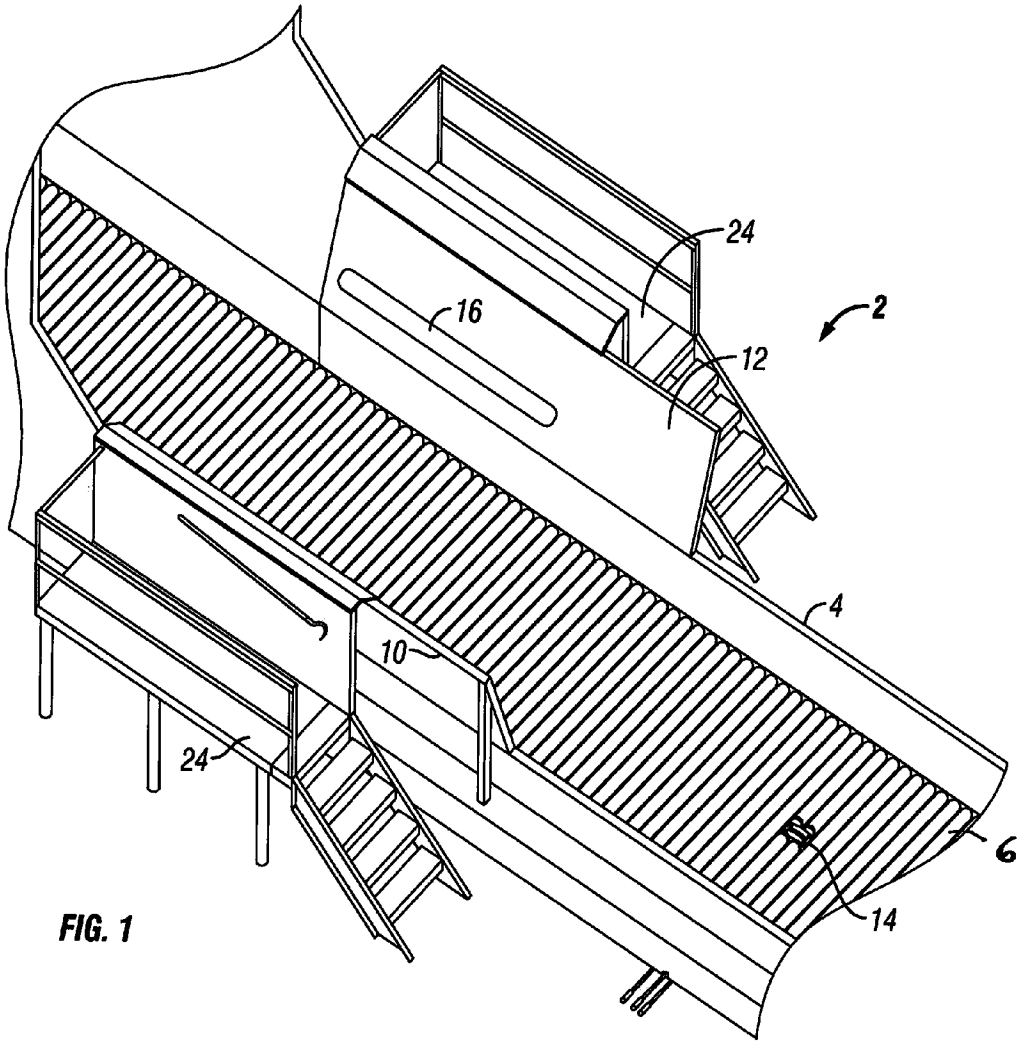
FIG. 1 is a perspective view of the module feeder system according to an example embodiment of the present invention.
Figure 2:
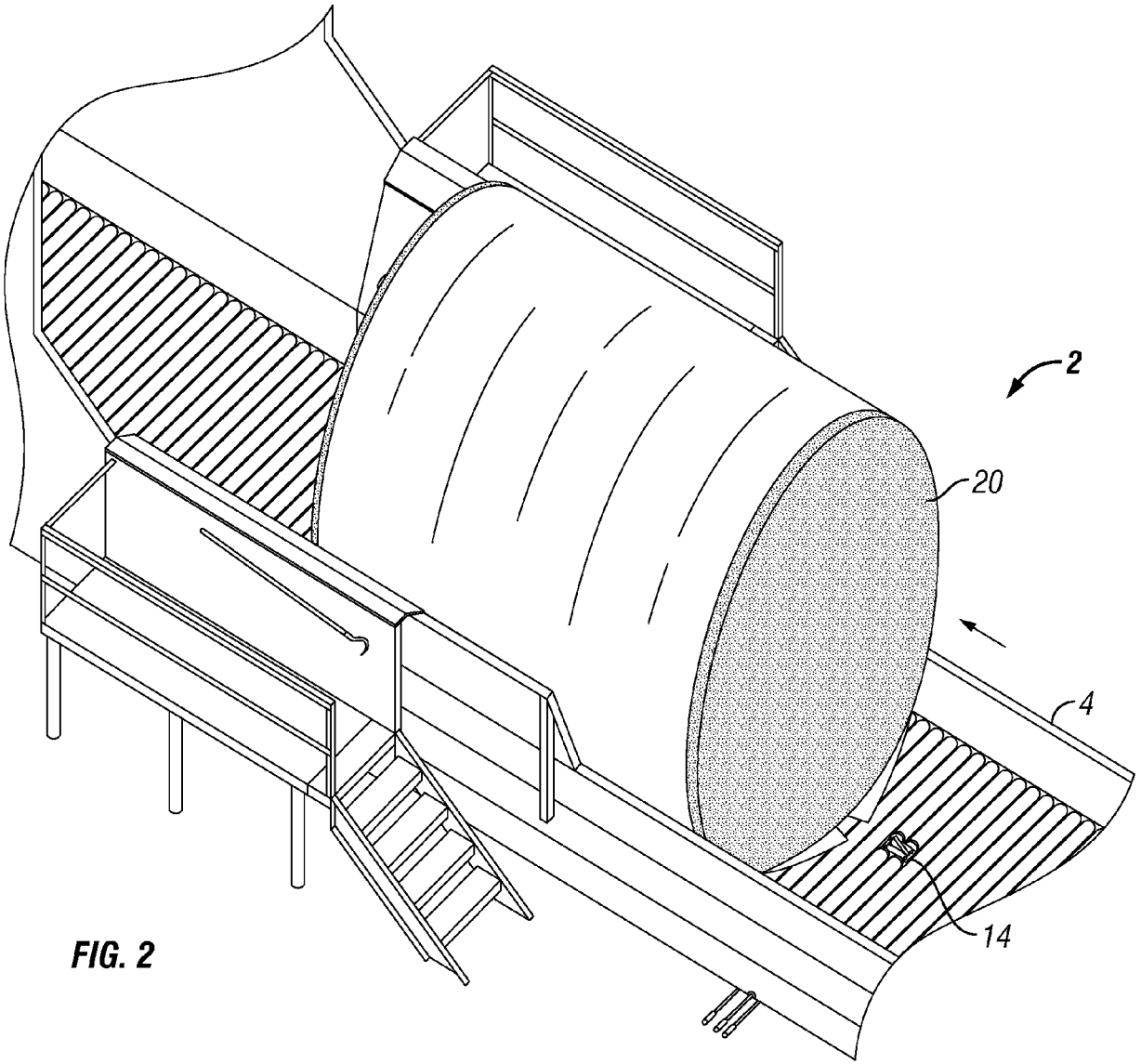
FIG. 2 is a perspective view of the module feeder system of FIG. 1 with a cotton module loaded onto the feeder bed.

Referring to FIGS. 1 to 2, a module feeder system 2 is disclosed. Module feeder system comprises a module feeder 4, a cutting device 14 and at least one hydraulic cylinder 16. In one embodiment, module feeder 4 comprises an unload bed 6, a feeder bed 8, a first side wall 10 and a second side wall 12. Module feeders typically consist of three sections of beds which include an unload, stage, and feed bed. The beds are used to move cotton modules into the gin. Module feeders typically comprise two and a half beds. The number of beds used on a module feeder may vary as desired by one skilled in the art. Unload bed 6 is typically 40 feet in length. A cotton module 20 is unloaded onto unload bed 6. Upon activation, module feeder 4 will move a cotton module 20 from the unload bed 6 to feeder bed 8. In one embodiment, module feeder 4 comprises a first side wall 10 and a second side wall 12. First side wall 10 and second side wall 12 are contiguous to feeder bed 8. First side wall 10 and second side wall 12 are typically forty two inches in height but their height may vary as needed by the module feeder style. In one embodiment, walkways 24 are adjacent to module feeder 4. Walkways 24 may extend the full length or partial length of module feeder 4.

Figure 3:
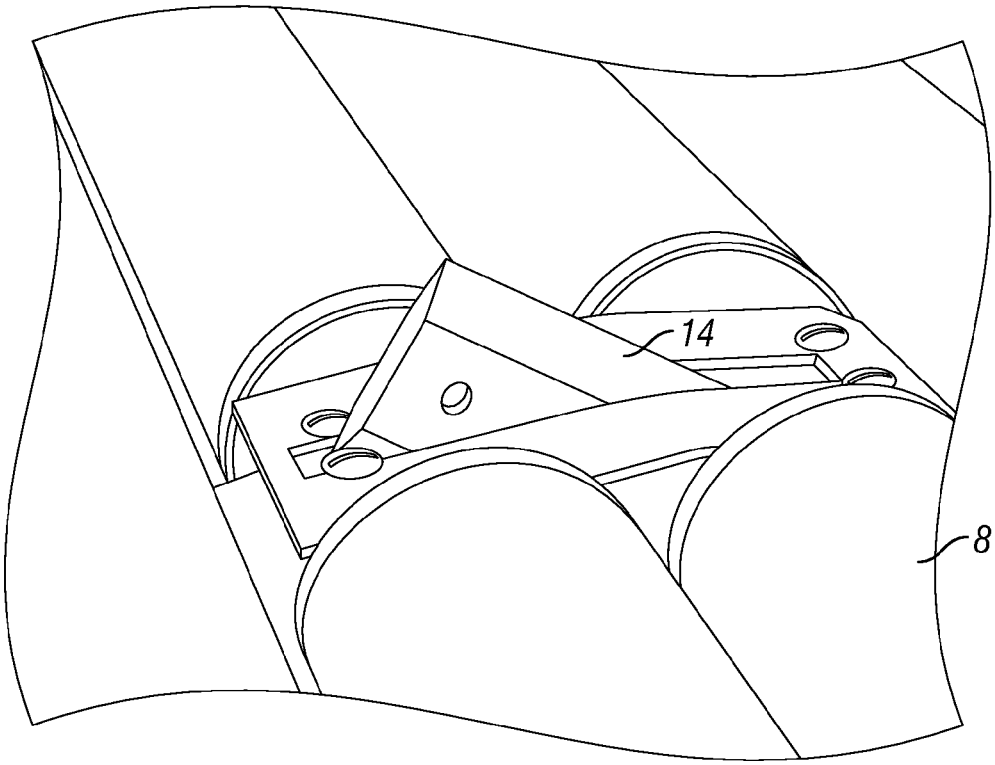
FIG. 3 is a close up perspective view of the cutting device of FIG. 1.

Referring now to FIGS. 1 to 3, in one embodiment, cutting device 14 is attached to feeder bed 8. Cutting device 14 may be located towards the front of the feeder bed 8 after the unload bed 6. Cutting device 14 may be located at any other location on the feeder bed 8 as desired by one skilled in the art. Cutting device 14 is used to cut the wrap or tarp that surrounds cotton modules. Cutting device 14 may be a blade. In one embodiment, cutting device 14 may be stationary and may permanently project from the feeder bed. In another embodiment, cutting device 14 may be retracted into feeder bed 8 and upon activation may project from the feeder bed 8. Cutting device 14 may be activated manually or automatically. In one embodiment, cutting device 14 may be activated by levers. In another embodiment, cutting device 14 is activated by hydraulic valve.

Figure 4:
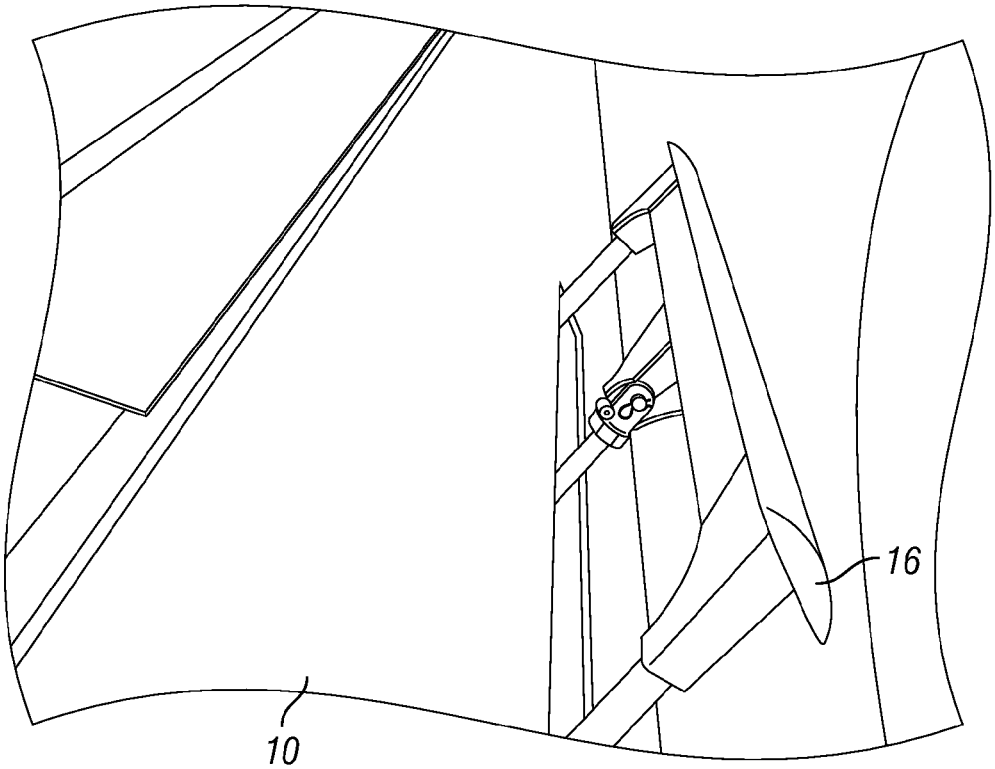
FIG. 4 is a close up perspective view of an hydraulic cylinder projecting from a side wall of FIG. 1.
Figure 5:
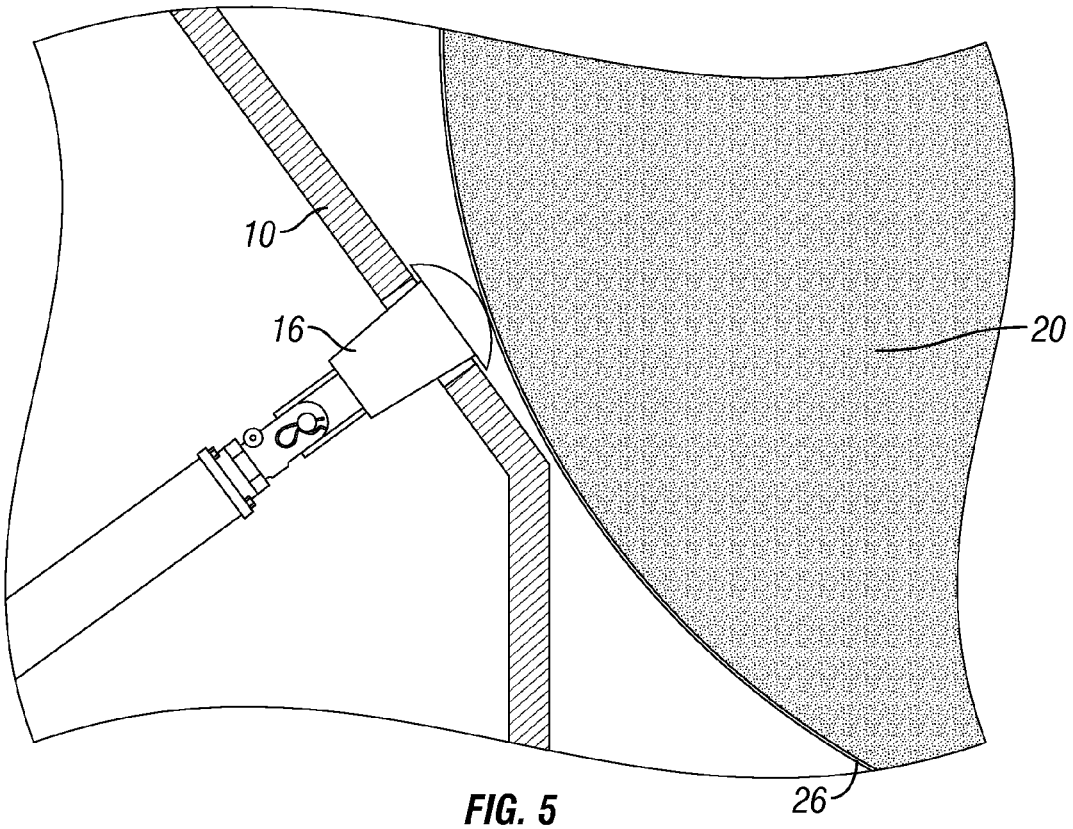
FIG. 5 is a cross sectional view of the hydraulic cylinder.
Figure 6:
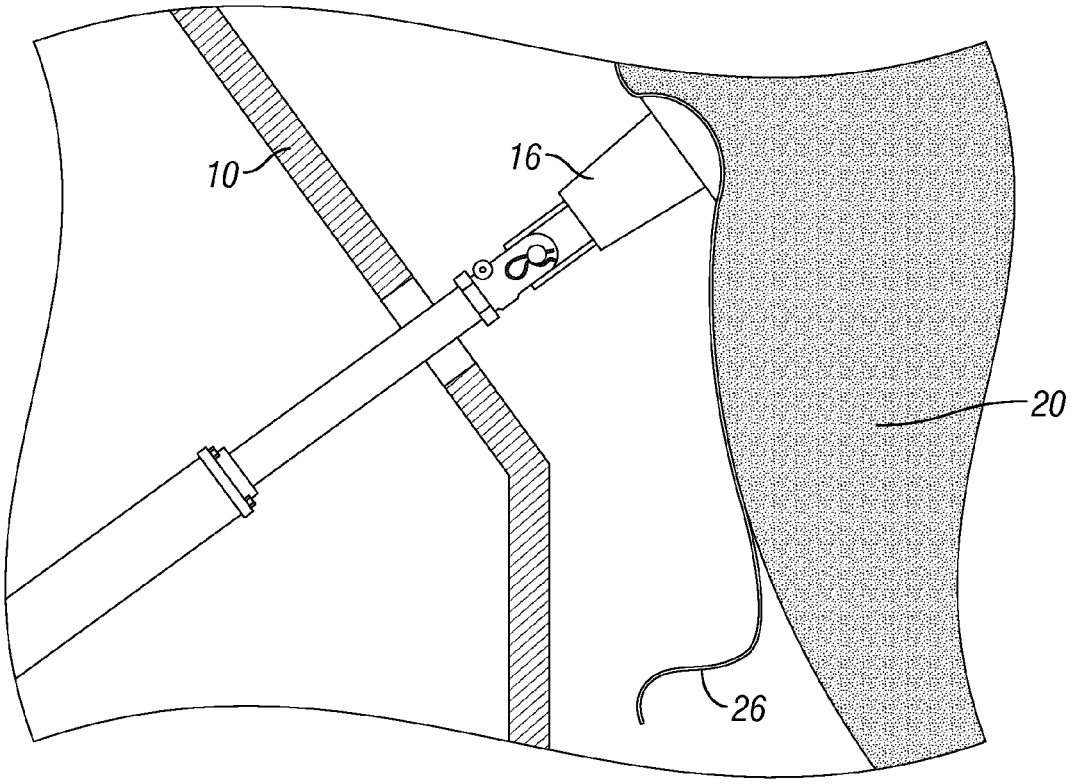
FIG. 6 is a cross sectional view of the hydraulic cylinder projecting from the side wall and into the cotton module.

Referring now to FIGS. 4 to 6, in one embodiment, at least one hydraulic cylinder 16 is positioned on each of the first side wall 10 and second side wall 12. Hydraulic cylinder 16 is configured to project in a direction away from first side wall 10 and second side wall 12 and over the feeder bed 8. In one embodiment, hydraulic cylinder 16 may be any apparatus that may be used to roll the cotton module 20. In one embodiment, one hydraulic cylinder 16 is positioned on first side wall 10 and second side wall 12. Any number of hydraulic cylinders may be used on each side wall, such as two hydraulic cylinders, as desired by one of skill in the art. In one embodiment, hydraulic cylinders 16 are activated by a hydraulic pump and valve system. In one embodiment, hydraulic cylinders 16 are about four feet in length when the module feeder 4 has a width of nine feet, but the length may vary as the width of module feeder 4 varies.

Figure 7:
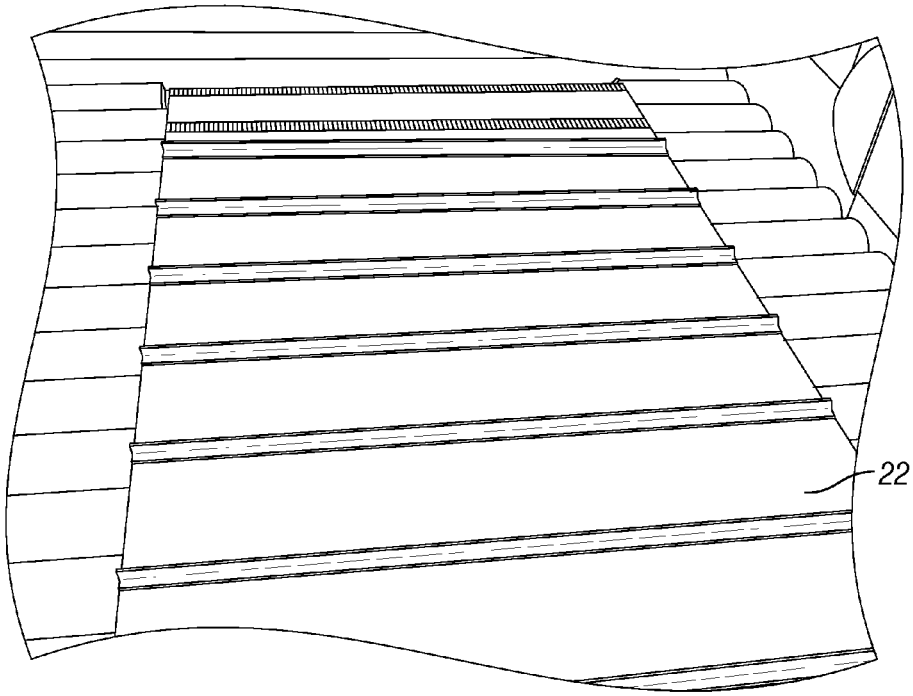
FIG. 7 is a perspective view of a module feeder system having a belt feed according to another example embodiment.
Figure 8:
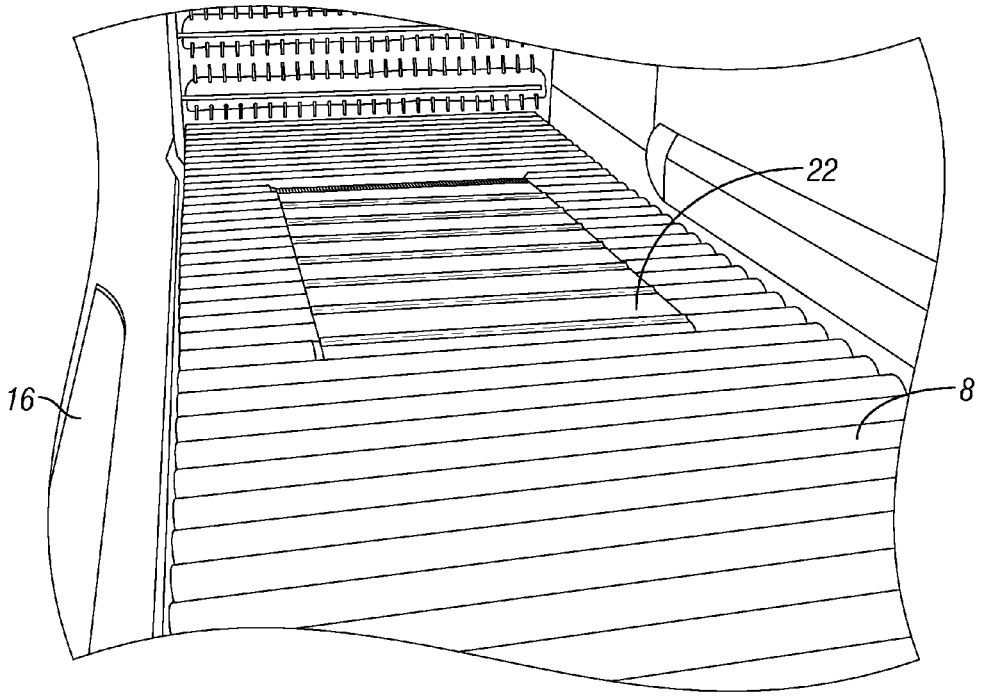
FIG. 8 is a perspective view of the belt feed of FIG. 7.

Referring now to FIGS. 7 and 8, in one embodiment, module feeder system 2 comprises belt feed 22 located at the end of feeder bed 8. After cotton module 20 is unwrapped, the previously wrapped cotton expands and drags on the side of the feeder 4. Belt feed 22 is used to carry cotton module 20 up to the disperser cylinders after cotton module 20 has been unwrapped. Belt feed 22 additionally keeps cotton from falling between the rollers of feeder bed 8.

A method used to unwrap a cotton module 20 is also disclosed. The method comprises the following steps: (a.) placing a wrapped cotton module 20 on a module feeder 4, wherein the module feeder 4 has an unload bed 6, a feeder bed 8, a first side wall 10 and a second side wall 12, wherein a cutting device 14 is attached to the feeder bed 8, wherein at least one hydraulic cylinder 16 is positioned on each of the first side wall 10 and second side wall 12, wherein each hydraulic cylinder 16 is configured to project in a direction away from the sidewalls 10 and 12 and over the feeder bed 8; (b.) activating the module feeder unload bed 6 and feeder bed 8; (c.) cutting the wrap 26 on the cotton module 20 with the cutting device 14 as the cotton module 20 moves onto the feeder bed 8; and (d.) removing the wrap 26 from the cotton module 20 by activating the hydraulic cylinders 16 which move the module from side to side releasing the wrap 26 and allowing wrap 26 to be removed.

A method used to unwrap a cotton module comprising the following steps is also disclosed: (a.) placing a wrapped cotton module on a module feeder having a feeder bed; (b.) activating the module feeder; (c.) cutting the wrap on the cotton module as the cotton module moves onto the feeder bed; and (d.) removing the wrap by rolling the module from side to side. The wrap may be cut with a cutting device. The module may be rolled by hydraulic cylinders or other apparatus.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the disclosed invention and equivalents thereof.

What is claimed is:

1. A module feeder system comprising:

a. a module feeder comprising an unload bed, a feeder bed, a first side wall and a second side wall;

b. a cutting device attached to the feeder bed; and c. at least one hydraulic cylinder positioned on each of the first and second side walls, wherein each hydraulic cylinder is configured to project in a direction away from first and second side wall and over the feeder bed.

2. The module feeder system of claim 1, wherein the cutting device is configured to project from the feeder bed.

3. The module feeder system of claim 1, wherein the cutting device is stationary.

4. The module feeder system of claim 1, wherein two hydraulic cylinders are positioned on each of the first and second side walls.

5. The module feeder system of claim 1, wherein the module feeder system comprises a belt feed.

6. A method used to unwrap a cotton module comprising:

a. placing a wrapped cotton module on a module feeder, wherein the module feeder has an unload bed, a feeder bed, a first side wall and a second side wall, wherein a cutting device is attached to the feeder bed, wherein at least one hydraulic cylinder is positioned on each of the first and second side walls, wherein each hydraulic cylinder is configured to project in a direction away from the sidewalls and over the feeder bed;

b. activating the module feeder unload bed and feeder bed;

c. cutting the wrap on the cotton module with the cutting device as the cotton module moves onto the feeder bed; and d. removing the wrap from the cotton module by activating the hydraulic cylinders which move the module from side to side releasing the wrap and allowing the wrap to be removed.

7. The method of claim 6, wherein the cutting device is configured to project from the feeder bed.

8. The method of claim 6, wherein the cutting device is stationary.

9. The method of claim 6, wherein two hydraulic cylinders are positioned on each of the first and second side walls.

* * * * *